US006644303B1

(12) United States Patent
Worthington et al.

(10) Patent No.: US 6,644,303 B1
(45) Date of Patent: Nov. 11, 2003

(54) SOLAR LIGHTER FOR A SMOKING INSTRUMENT

(76) Inventors: Keith Worthington, P.O. Box 4144, Big Bear Lake, CA (US) 92315; John Hobill, P.O. Box 1027, Sugarloaf, CA (US) 92386

( * ) Notice: Subject to any disclaimer, the term of this patent is extended or adjusted under 35 U.S.C. 154(b) by 0 days.

(21) Appl. No.: 10/214,110

(22) Filed: Aug. 8, 2002

Related U.S. Application Data

(60) Provisional application No. 60/323,385, filed on Sep. 20, 2002.

(51) Int. Cl.[7] ..... F24J 2/02; F24J 2/08

(52) U.S. Cl. ..... 126/680; 126/699; 126/700

(58) Field of Search ..... 126/680, 698, 126/699, 700

(56) References Cited

U.S. PATENT DOCUMENTS

| | | | | |
|---|---|---|---|---|
| 1,224,011 A | * | 4/1917 | Parker | 126/680 |
| 1,838,494 A | | 12/1931 | Neuwirth | |
| D137,806 S | | 5/1944 | Duescher | |
| 4,076,014 A | | 2/1978 | Wiquel | |
| 4,398,800 A | * | 8/1983 | Hayes | 359/818 |
| 4,610,240 A | | 9/1986 | Burch | |
| 4,934,384 A | * | 6/1990 | Graham | 131/176 |
| 5,365,670 A | * | 11/1994 | Klimochko | 42/119 |
| 6,356,400 B1 | * | 3/2002 | Goff et al. | 359/802 |
| 6,476,984 B1 | * | 11/2002 | Ringdahl | 359/803 |

FOREIGN PATENT DOCUMENTS

| | | |
|---|---|---|
| DE | 222250 | 5/1910 |
| FR | 2 309 808 | * 11/1976 |

* cited by examiner

*Primary Examiner*—Alfred Basichas
(74) *Attorney, Agent, or Firm*—Patent & Trademark Services; Joseph H. McGlynn

(57) ABSTRACT

A solar powered pipe for use in igniting pipe tobacco. The solar pipe has a light concentrating lens to direct the sun's rays onto the tobacco in a pipe and a retractable arm to regulate the intensity of the heat over the tobacco from the light concentrating lens. Both the lens and the retractable arm are connected to a mounting plate by pivotal joints. When the solar pipe lighter is not in use, it may be folded to fit inside a pocket.

12 Claims, 1 Drawing Sheet

SOLAR LIGHTER FOR A SMOKING INSTRUMENT

Applicant claims priority of Provisional application Ser. No. 60/323,385, filed Sep. 20, 2002.

BACKGROUND OF THE INVENTION

This invention relates, in general, to a tobacco pipe, and in particular, to a solar powered pipe, which uses the rays of the sun for its source of power to ignite the tobacco in a pipe.

DESCRIPTION OF THE PRIOR ART

In the prior art, various types of solar powered cigarette, cigar, and tobacco lighters have been proposed. For example, U.S. Pat. No. 4,610,240 to Burch discloses a pipe lighter comprising a cylinder with a lens mounted to the pipe.

U.S. Pat. No. 4,076,014 to Wiquel discloses a cigarette lighter comprising a tube with a lens at one end and an open end at the opposite end to receive a cigarette.

U.S. Pat. No. 1,838,494 to Neuwirth discloses a combination magnifying glass and compass.

U.S. Pat. No. Des 137,806 to Duescher discloses a design for a solar cigarette lighter.

German Patent No. 222,250 to Wenchenbach discloses a glass mounted on an arm to light a cigar.

SUMMARY OF THE INVENTION

The present invention is directed toward a solar pipe lighter. The solar pipe lighter is a tobacco lighter that uses the sun's rays as its fuel source. The solar pipe lighter has a magnifying or light concentrating lens and a lens holder, attached to a pivotal arm member. The pivotal arm member is attached to a mounting plate by a pivotal joint. A separate retractable arm member is also attached to the mounting plate by a pivotal joint. The light concentrating lens and pivotal arm member and the retractable arm member are each separately attached by pivotal joints to the mounting plate.

It is an object of the present invention to provide a new and improved means for a user of pipe tobacco to light the tobacco while reducing the amount of carcinogenic material inhaled.

It is an object of the present invention to provide a means for reducing the amount of pollution caused by fossil fuel lighters.

These and other objects and advantages of the present invention will be fully apparent from the following description when taken in connection with the annexed drawings.

DESCRIPTION OF THE PREFERRED EMBODIMENTS

Figure 1:
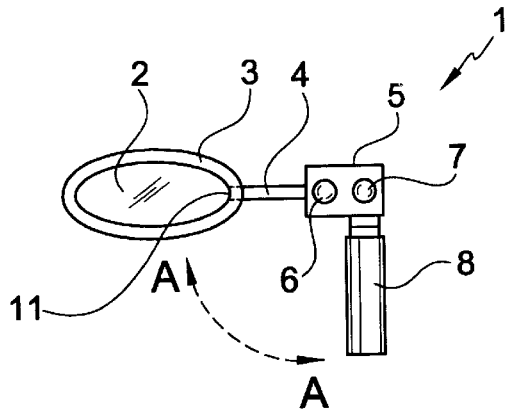
FIG. 1 is a side view of the solar pipe lighter with the retractable arm in the closed position.

Referring now to the drawings in greater detail, FIG. 1 shows a solar pipe 1, for lighting pipe tobacco in the bowl of a pipe 9. The solar pipe uses a light concentrating lens 2 and a light source, such as the suns rays, to ignite the smoking tobacco in the pipe 9. The solar pipe 1 has a light concentrating lens 2 enclosed in a lens holder 3 of any conventional design. It should be noted that the lens holder 3 and the lens 2 shown in the drawings are circular, however, this is merely for illustrational purposes. The shape of the lens and lens holder can be shapes other than circular, such as, but not limited to, square, rectangular, and oval. A pivotal arm 4 is attached to a mounting plate 5, by a pivotal joint 6, and the arm 4 is attached to the lens holder 3 by another pivotal joint 11. The pivot joints 6, 11 can be any conventional pivot joint, such as, but not limited to, ball and socket joints, that will allow the lens holder 3 to pivot in order to align the sun with the lens. This will allow the lens holder, and the lens 2, to be pivoted to any position necessary to focus the rays of the sun through the lens and onto the tobacco in the bowl of the pipe 9.

Figure 2:
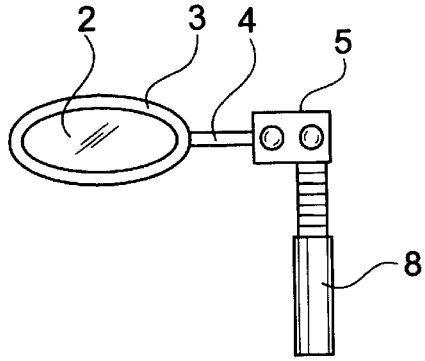
FIG. 2 is a side view of the solar pipe lighter with the retractable arm in the extended position.

A retractable arm 8 is attached to the mounting plate 5 by another pivotal joint 7, which is similar to pivot joint 6 and which serves the same purpose, i.e. to allow the lens 2 to be properly adjusted with respect to the tobacco in the bowl of pipe 9. The retractable arm 8 can be moved from a closed position, as shown in FIG. 1, to an extended position, as shown in FIG. 2. By adjusting the length of the retractable arm 8, a user can adjust the distance the lens 2 is from the bowl of the pipe 9. This will allow him/her to concentrate the rays of the sun so they will be able to effectively ignite the tobacco. The retractable arm 8 can be any type of arm, such as a telescoping arm, which will perform the intended function.

The retractable arm 8 may be extended upward or downward and the light concentrating lens 2 may be moved left and right, in order to focus and intensify the solar rays over the tobacco so that it can ignite in the pipe. The pivotal joint 6 enables the pivotal arm 4, and the lens 2, attached thereto, to be rotated to focus the solar rays over the tobacco, and, thus, may be used in conjunction with the upward and downward movement of the retractable arm 8, to ignite the tobacco.

The pivotal joint 7 enables the retractable arm 8 and the lens 2, along with arm 4, to fold together, as shown by the dotted lines AA in FIG. 1. When the solar pipe is not in use, it can be folded together, as shown in FIG. 3, for storing in a pocket or tobacco pouch.

FIG. 2 shows the present invention 1 with the retractable arm member 8 in the extended position. The user may regulate the intensity of the suns rays coming through the light concentrating lens 2 by moving the retractable arm 8 upwards or downwards over the pipe tobacco.

Figure 3:
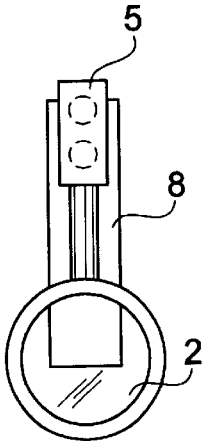
FIG. 3 is a side view of the solar pipe lighter in the closed position.

The light concentrating lens 2 may be rotated to the left and to the right by pivotal joint 6 on the mounting plate 5, to better aim the suns rays over the tobacco inside the pipe FIG. 3 of the present invention shows the solar pipe lighter 1 folded when it is not in use. The retractable arm 8 is closed to make the invention as small as possible in its folded position. The light concentrating lens 2 and lens holder 3, as well as the mounting plate 5, may be folded on top of , and in alignment with, retractable arm 8 by pivoting these elements about pivotal joint 7 on the mounting plate 5. Thus, the solar pipe 1 may be folded together to fit into a pocket, tobacco pouch, or other flat space.

Figure 4:
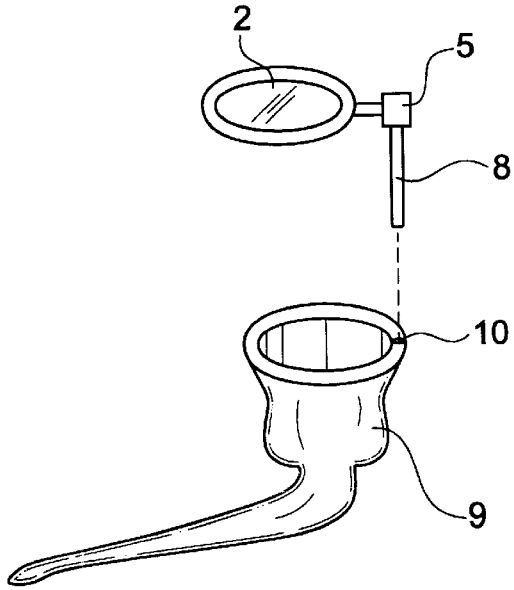
FIG. 4 is a perspective view of the solar pipe lighter about to be attached to a tobacco pipe.

FIG. 4 shows the light concentrating lens 2 separated from the pipe 9, however, this is merely for illustrational purposes. The retractable arm 8 and lens 2 is one unit. Retractable arm 8 is shown in the extended position adjacent to the pipe 9 in FIG. 4. The user can hold the retractable arm 8 in one hand and the pipe in the other hand, and aim the rays of the sun into the light concentrating lens 2 over the pipe bowl 9 in order to light the tobacco.

In the alternative, an aperture 10 can be positioned on the rim of the pipe 9 and the arm 8 can be permanently inserted into the aperture 10. This will free one of the user's hands except to position the lens 2.

The retractable arm 8 may be raised or lowered, as necessary, to maximize the focusing of the rays of the sun on the tobacco. Also, the user can utilize the pivot joints 6, 7, 11 to achieve the best angle of the rays through the lens 2.

When the solar pipe lighter is not being used, the light magnifying lens 2, attached to the pivotal arm member 4, may be folded at the pivotal joint 6 on the mounting plate 5 such that the lens and pivotal arm member is resting flat on top of the retractable arm 8, as shown in FIG. 3, thereby allowing the solar lighter to fold together and to fit compactly into a pocket or other flat space.

We claim:

1. A solar lighter for a smoking instrument, said solar lighter comprising:

a first arm, said first arm having a length and a width and first end and a second end, said first arm being mounted at said first end to a mounting plate, a second arm, said second arm having a length and a width and a first end and a second end, said second arm being mounted at said first end of said second arm to said mounting plate, a lens secured to said second arm at said second end of said second arm, said lens being movable with respect to said second arm, and wherein said first arm is expandable from a first length to a second length, and said second length is longer than said first length.

2. The solar lighter as claimed in claim 1, wherein said lens is pivotably mounted to said second arm.

3. The solar lighter as claimed in claim 1, wherein said second arm is pivotally mounted to said mounting plate.

4. The solar lighter as claimed in claim 1, wherein said first arm is pivotally mounted to said mounting plate.

5. The solar lighter as claimed in claim 1, wherein a frame is secured around said lens, and said frame is secured to said second end of said second arm.

6. The solar lighter as claimed in claim 5, wherein said frame is pivotally secured to said second end of said second arm.

7. A solar lighter for a smoking instrument, said solar lighter comprising:

a first arm, said first arm having a length and a width and first end and a second end, said first arm being mounted at said first end to a mounting plate, a second arm, said second arm having a length and a width and a first end and a second end, said second arm being mounted at said first end of said second arm to said mounting plate, a lens secured to said second arm at said second end of said second arm, said lens being movable with respect to said second arm, and wherein said pipe has means for receiving said second end of said first arm.

8. The solar lighter as claimed in claim 7, wherein said lens is pivotably mounted to said second arm.

9. The solar lighter as claimed in claim 7, wherein said second arm is pivotally mounted to said mounting plate.

10. The solar lighter as claimed in claim 7 wherein said first arm is pivotally mounted to said mounting plate.

11. The solar lighter as claimed in claim 7, wherein a frame is secured around said lens, and said frame is secured to said second end of said second arm.

12. The solar lighter as claimed in claim 11, wherein said frame is pivotally secured to said second end of said second arm.

* * * * *